US007003801B2

(12) United States Patent
Grilliot et al.

(10) Patent No.: US 7,003,801 B2
(45) Date of Patent: Feb. 28, 2006

(54) HELMET COVER AND SHROUD SET FOR FIREFIGHTER OR EMERGENCY WORKER

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 63 days.

(21) Appl. No.: 10/726,219

(22) Filed: Dec. 2, 2003

(65) Prior Publication Data

US 2005/0114974 A1 Jun. 2, 2005

(51) Int. Cl.
*A42B 3/00* (2006.01)

(52) U.S. Cl. ..... 2/5

(58) Field of Classification Search ..... 2/5, 2/7, 8, 202, 205, 206, 207, 410, 468, 906, 2/909

See application file for complete search history.

(56) References Cited

U.S. PATENT DOCUMENTS 4,091,469 A * 5/1978 Davidson ..... 2/410
4,184,212 A * 1/1980 Bowman ..... 2/5
4,272,853 A * 6/1981 Schuessler ..... 2/424
4,803,109 A * 2/1989 Saniscalchi ..... 428/104
4,887,319 A * 12/1989 Daniels ..... 2/410
5,062,163 A * 11/1991 Avey ..... 2/424
6,006,360 A * 12/1999 Reed ..... 2/202
6,260,207 B1 7/2001 Barbeau et al.

FOREIGN PATENT DOCUMENTS

JP 406041806 A * 2/1994

* cited by examiner

*Primary Examiner*—Gary L. Welch
(74) *Attorney, Agent, or Firm*—Wood, Phillips, Katz, Clark & Mortimer

(57) ABSTRACT

In a set of protective gear for a firefighter or for an emergency worker, a helmet is covered by an aluminized cover, which is joined to an aluminized shroud along an uninterrupted juncture, so as to eliminate any gap between the shroud and the cover, where the cover is joined to the shroud. In a preferred embodiment, the uninterrupted juncture is defined by a permanent seam, which is sewn and which may be sealed by an adhesive sealant so as to be fluid-impervious. Being uninterrupted, the seam impedes and, if sealed by an adhesive sealant, blocks infiltration of heat, water, gases, or smoke between the shroud and the cover. In an alternative embodiment, cover and the shroud have common region including the uninterrupted juncture, the common region being aluminized. The common region blocks infiltration of heat, water, gases, or smoke between the shroud and the cover.

3 Claims, 2 Drawing Sheets

HELMET COVER AND SHROUD SET FOR FIREFIGHTER OR EMERGENCY WORKER

TECHNICAL FIELD OF THE INVENTION

This invention pertains to an improvement in a set of protective gear, which includes a helmet, a cover for the helmet, and a shroud, for a firefighter, an emergency worker, or another wearer requiring similar protection.

BACKGROUND OF THE INVENTION

Commonly, a set of protective gear for such a wearer includes a helmet, a cover for the helmet, and a shroud, which may be suspended from an internal harness of the helmet. Commonly, the cover and the shroud have outer surfaces that are aluminized so as to be heat-reflective. National Fire Protection Association 1976 (2000 Edition) Standards apply.

U.S. Pat. No. 6,260,207 B1 to Barbeau et al. discloses such a set of protective gear, in which snap fasteners ("snapping heads" and "snapping hooks") are used to join the shroud to the cover for the helmet, at intervals along an upper edge of the shroud and completely around the head of the wearer.

SUMMARY OF THE INVENTION

This invention provides an improvement in a set of protective gear, which includes a helmet, a cover for the helmet, and a shroud, for a firefighter or for an emergency worker. The cover and the shroud may comprise plural fabric layers. Outer surfaces of the cover and of the shroud may be heat-reflective and may be aluminized so as to be heat-reflective. Broadly, the improvement entails that the cover is joined to the shroud along an uninterrupted juncture extending around a posterior portion of the head of the wearer but, preferably, not around an anterior portion of the head of the wearer, so as to eliminate any gap between the shroud and the cover, where the cover is joined to the shroud.

Preferably, the uninterrupted juncture is provided by a permanent seam, which may be sewn and, if sewn, which may be sealed by an adhesive sealant so as to be fluid-impervious. Being uninterrupted, the seam impedes and, if sealed by an adhesive sealant, blocks infiltration of heat, water, gases, or smoke between the shroud and the cover.

Alternatively, the cover and the shroud comprise, along the uninterrupted juncture, a common region forming an integral part of the cover and forming an integral part of the shroud. The outer surface of the common region may be heat-reflective and may be aluminized so as to be heat-reflective.

DETAILED DESCRIPTION OF THE ILLUSTRATED EMBODIMENTS

Figure 1:
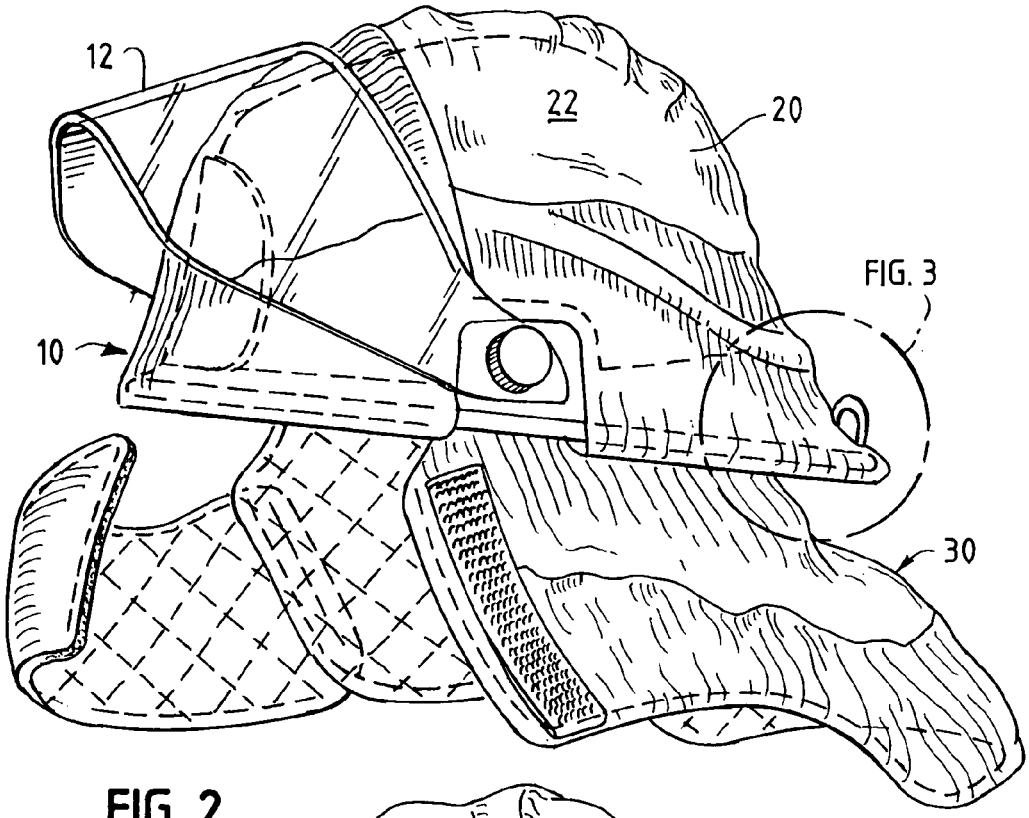
FIG. 1 is a perspective view taken from one side and illustrating, apart from a wearer, a set of protective gear embodying this invention.
Figure 2:
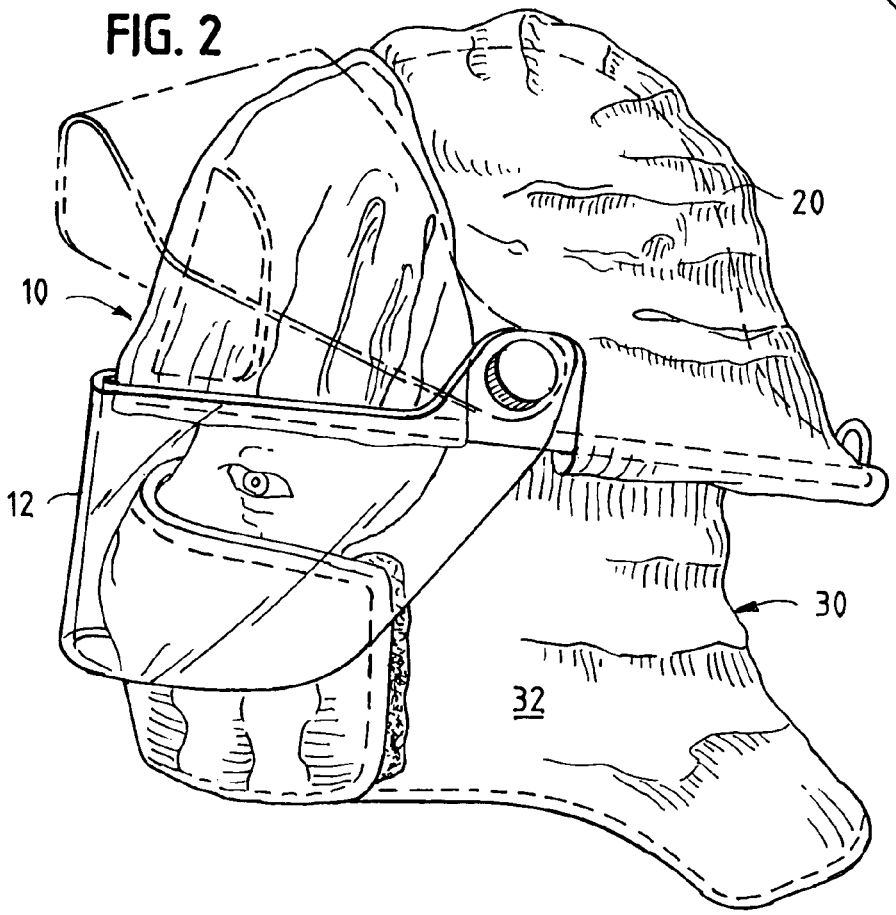
FIG. 2 is a similar view illustrating the same set being worn by a wearer whose face is illustrated partially.

As illustrated in FIGS. 1 and 2, a set of protective gear for a firefighter, an emergency worker, or another wearer requiring similar protection comprises a helmet 10, which is adapted to cover upper portions of the head of a wearer, a cover 20, which is adapted to cover the helmet, and a shroud 30, which is adapted to cover lower portions of the head, face, and neck of the wearer. As illustrated, the helmet 10 mounts a transparent, eye-protecting shield 12, which is outside the scope of this invention.

The cover 20 is made from a suitable fabric having plural layers, two layers being illustrated, wherein the inner layer is thermally insulative, wherein the outer layer may be woven from Nomex™ fiber or from another fiber used commonly in outer layers of protective garments for firefighters, wherein the outer layer is heat-reflective, and wherein the outer surface 22 of the outer layer may be aluminized so as to be heat-reflective. The shroud 30, which is made from a similar fabric having plural layers, two layers being illustrated, wherein the inner layer is thermally insulative, wherein the outer layer may be woven from Nomex™ fiber or from another fiber used commonly in outer layers of protective garments for firefighters, wherein the outer layer is heat-reflective, and wherein the outer surface 32 of the outer layer may be aluminized so as to be heat-reflective. The shroud 30 is suspended, in a known manner, from an internal harness 14 of the helmet 10.

Figure 3:
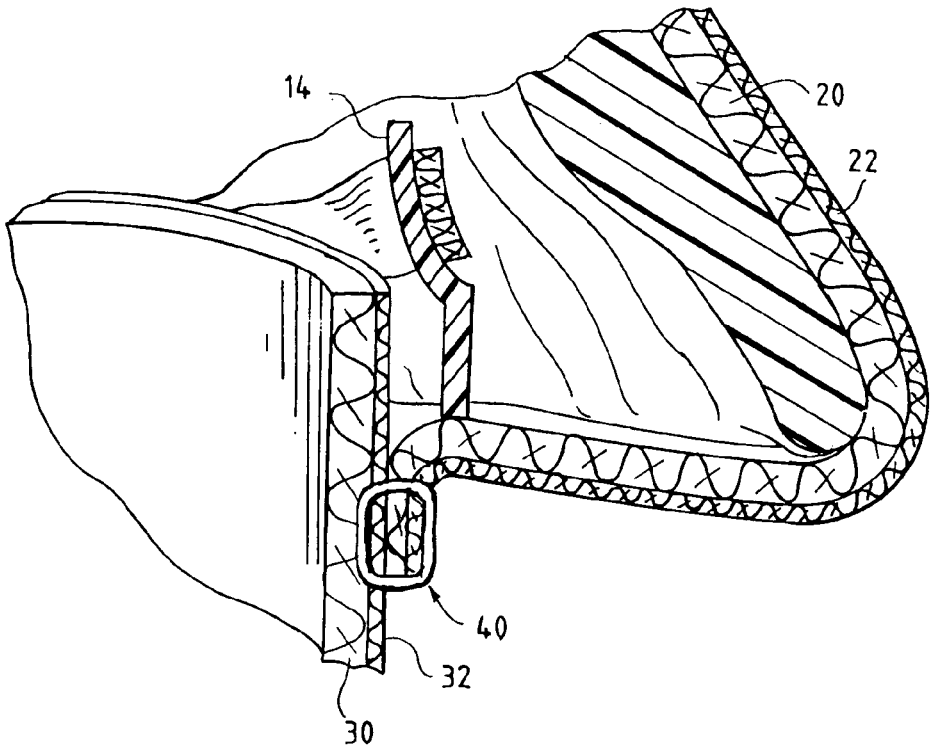
FIG. 3, which illustrates a preferred embodiment of this invention is an enlarged, sectional detail, as taken in a region indicated by a broken-line circle in FIG. 1.

In the preferred embodiment illustrated in FIG. 3, the cover 20 is joined to the shroud 30 along an uninterrupted juncture, which is defined by a permanent seam 40 extending around a posterior portion of the head of the wearer but not around an anterior portion of the head of the wearer, so as to eliminate any gap between the shroud 30 and the cover 20, where the cover 20 is joined to the shroud 30. As illustrated, the seam 40 is sewn. Optionally, and preferably, if the seam 40 is sewn, the seam 40 is sealed by an adhesive sealant so as to be fluid-impervious. In the preferred embodiment, the seam 40 defining the uninterrupted juncture impedes and, if the seam 40 is sealed by an adhesive sealant, blocks infiltration of heat, water, gases, smoke, hazardous chemicals, or biologically hazardous agents between the shroud 30 and the cover 20.

Figure 4:
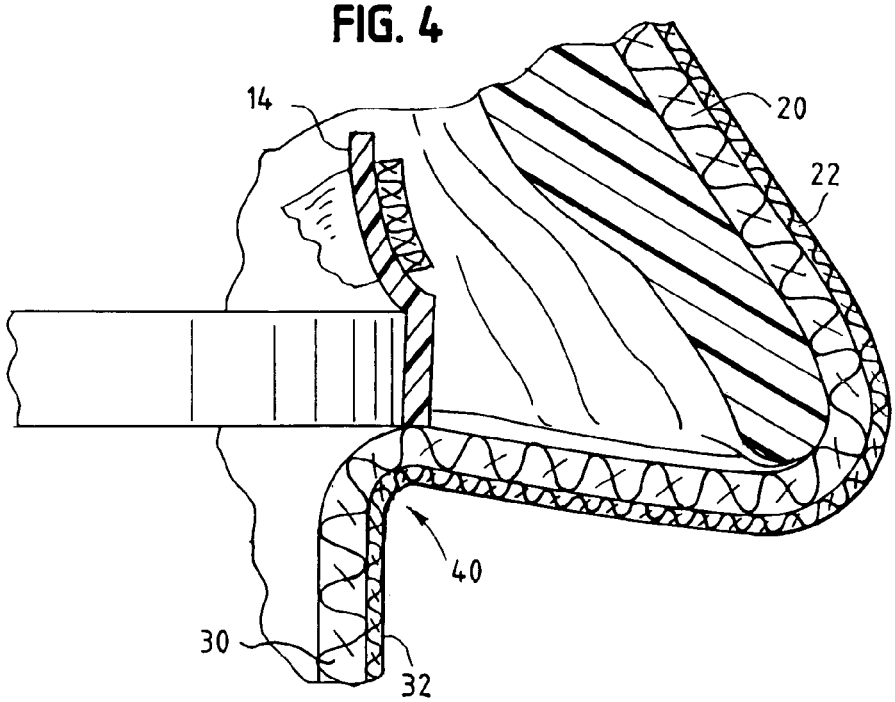
FIG. 4 is an analogous detail illustrating an alternative embodiment of this invention.

In the alternative embodiment illustrated in FIG. 4, the cover 20 and the shroud 30 comprise, along an uninterrupted juncture extending around a posterior portion of the head of the wearer but not around an anterior portion of the head of the wearer, a common region forming an integral part of the cover 20 and forming an integral part of the shroud 30. The common region has plural layers, two layers being illustrated, wherein the inner layer is thermally insulative, wherein the outer layer may be woven from Nomex™ fiber or from another fiber used commonly in outer layers of protective garments for firefighters, wherein the outer layer is heat-reflective, and wherein the outer surface 22, 32, of the outer layer may be aluminized so as to be heat-reflective. The common region includes the uninterrupted juncture and includes adjacent portions of the cover 20 and of the shroud 30. The common region may extend substantially all of the cover 20, over substantially all of the shroud 30, or over substantially all of both. In the alternative embodiment, the common region including the uninterrupted juncture blocks infiltration of heat, water, gases, smoke, hazardous chemicals, or biologically hazardous agents between the shroud 30 and the cover 20.

What is claimed is:

1. In a set of protective gear for a firefighter or for an emergency rescue worker, the set comprising a helmet, which is adapted to cover upper portions of the head of a wearer, a cover, which is adapted to cover the helmet, and a shroud, which is adapted to cover lower portions of the head, face, and neck of the wearer, an improvement wherein the cover is joined to the shroud along an uninterrupted juncture defined by a permanent seam extending around a posterior portion of the head of the wearer but not around an anterior portion of the head of the wearer, so as to eliminate any gap between the shroud and the cover, whether the cover is joined to the shroud.

2. The improvement of claim 1, wherein the seam is sewn.

3. The improvement of claim 2, wherein the seam is sealed so as to be fluid-impervious.

* * * * *